US006206165B1

(12) United States Patent
Lenander

(10) Patent No.: US 6,206,165 B1
(45) Date of Patent: Mar. 27, 2001

(54) SYSTEM FOR PROMOTING THE RETURNING OF SERVICE CARTS, E.G. SHOPPING CARTS, INTENDED FOR TRANSPORTING COMMODITIES IN AN ACTIVITY CENTER, E.G. SHOPPING CENTERS

(75) Inventor: Aage Lenander, Rungsted Kyst (DK)

(73) Assignee: Catena-Systems APS, Horsholm (DK)

( * ) Notice: Subject to any disclaimer, the term of this patent is extended or adjusted under 35 U.S.C. 154(b) by 0 days.

(21) Appl. No.: 09/423,547

(22) PCT Filed: May 7, 1998

(86) PCT No.: PCT/DK98/00181

§ 371 Date: Nov. 12, 1999

§ 102(e) Date: Nov. 12, 1999

(87) PCT Pub. No.: WO98/51197

PCT Pub. Date: Nov. 19, 1998

(30) Foreign Application Priority Data

May 13, 1997 (DK) ..... 0550/97

(51) Int. Cl.[7] ..... G07F 7/00; G08B 13/14
(52) U.S. Cl. ..... 194/213; 194/905; 340/568.5
(58) Field of Search ..... 194/205, 213, 194/905; 340/568.5

(56) References Cited

U.S. PATENT DOCUMENTS

| | | | | |
|---|---|---|---|---|
| 5,119,087 | | 6/1992 | Lucas | 194/213 |
| 5,402,106 | * | 3/1995 | DiPaolo et al. | 348/568.5 |
| 5,485,006 | * | 1/1996 | Allen et al. | 340/568.5 |
| 5,646,616 | * | 7/1997 | Komatsu | 340/568.5 |
| 5,921,373 | * | 7/1999 | Amdahl et al. | 194/213 |

FOREIGN PATENT DOCUMENTS

| | | |
|---|---|---|
| 31 12 655 | 10/1982 | (DE) . |
| 84/04660 | 12/1984 | (WO) . |
| 85/00961 | 3/1985 | (WO) . |
| 97/11441 | 3/1997 | (WO) . |

* cited by examiner

*Primary Examiner*—Dean J. Kramer
*Assistant Examiner*—Bryan Jaketic
(74) *Attorney, Agent, or Firm*—Larson & Taylor, PLC

(57) ABSTRACT

In a returning system for service carts (24), said system comprising electronic monitoring of the movement of the carts (24) through an activity area, the main novel features are a) that the returning system is an electronic system operable in a deposit-free manner, the elements of said system being mutually related in a compulsorily activating manner from a collection station, at which the carts stand in readiness to be collected, and via an activity area again back to a readiness collection station, b) that the system comprises an electronic signal director (20) that is both controllable and/or controlling and comprises fixed and variable functions, c) that the system further comprises, c1) mobile electronic communication devices (28) intended and constructed for placement on the system's service carts (24) so as to accompany the latter, each of said communication devices (28) being adapted for electronic identification of the particular service cart on which it is placed, and c2) stationary electronic devices (18) adapted to record the identity of the cart concerned and to be connected for communication to said signal director (20), said stationary devices (18) being placed in a mutual sequence in such a manner that they co-operate to form a path of advancement extending from a cart-collection station (14, 15), through said activity area, and back to a cart-collection station (14, 15), said path to be followed by the service carts (24) for triggering electrical signals for the activation of the signal director (20), and d) that said signal director (20) is connected for communication with an indicator (17, 30) adapted to make known the giving of a reward caused by the returning of a cart.

4 Claims, 6 Drawing Sheets

SYSTEM FOR PROMOTING THE RETURNING OF SERVICE CARTS, E.G. SHOPPING CARTS, INTENDED FOR TRANSPORTING COMMODITIES IN AN ACTIVITY CENTER, E.G. SHOPPING CENTERS

TECHNICAL FIELD

The present invention relates to a returning system for service carts, said system comprising electronic monitoring of the movements of said carts through an activity area.

The present invention is particularly directed to the problem of promoting the returning of service carts, e.g. shopping carts, for transporting commodities in an activity area, e.g. shopping centers, said carts after having been fetched from a collection station and after having been available for the transportation of commodities, should be returned to a collection station to be used again.

BACKGROUND ART

Experience has shown that it is costly and time-consuming to let the staff collect service carts that have been used. For this reason, the practice has been introduced in many places of making a service cart available solely upon payment of a deposit, being refunded when the cart is returned. This practice is, however, by the users often experienced as a rather complicated course of action. Systems comprising both electronic monitoring and payment of a deposit are known from the International Patent Applications No. WO 84104660 and No. WO 97/11441.

WO 84/04660 discloses a system, in which the electronic monitoring serves to ascertain whether a service cart belongs to a predetermined collection station, after which a deposit has to be paid in order to get the service cart free for use in an activity area.

U.S. Pat. No. 5,119,087 discloses a deposit free system in which each cart is provided with a target, while a sensor detects the return of a shopping cart to a cart-returning station. According to a counter system, aprize is awarded to the person returning the shopping cart to the returning station.

WO 97/11441 discloses a system specially adapted for lending and re-parking of service carts from different shops. The system is based upon the payment of a refund of at least part of a lending deposit when the cart is returned.

DISCLOSURE OF THE INVENTION

It is the object of the invention to provide a system that is adapted to make the returning of a service cart attractive for the user without having to involve her or him in a deposit system.

This object is achieved with a system of the kind referred to initially, according to the present invention being constructed and adapted in the manner set forth in the characterizing clause of claim 1.

With such a system it is not only possible to record the returning of the service cart, but it is also possible, via the signal director and the indicator and based upon the recording of the cart having been carried out, to allocate a reward for the returning of a service cart having been borrowed, to users, groups of users or even individually selected users, so as to make it attractive for the users to return the service carts in a proper manner, with consequently improved utilization of the capacity of the available fleet of carts.

Further, the use of a central signal director makes it possible in the system to incorporate a winner frequency, determining to how many of the service carts in circulation a reward prize is to be allocated. The same means may be used to take account of the period of time, during which the service cart has been present in the activity area between the time of collection and the time of returning. It is e.g. possible to reduce, or even eliminate completely, the winner chances for carts for which only very short residence periods have been recorded, and increase them for carts not having been returned e.g. even after several hours, and for this reason must be presumed as having been left on e.g. parking lot. If so, an increased winner chance could motivate a third party to return the service cart in a proper manner and so reap a reward in the form of a prize.

Especially in those cases, in which the system comprises a number of collection stations for service carts, e.g. both out-of-doors and indoors, the system according to an embodiment of the invention also makes it possible, e.g. by director control of a number of indicators, to influence the flow of service carts in such a manner that it is possible to restrict or even completely avoid local accumulations of carts and consequently necessary manual transfers of greater number of carts during the day from one collection station to another.

The recording of service carts, upon which the system according to an embodiment of the invention is based, can also prevent service carts belonging to other systems from entering the system according to the invention without the requisite basic registration, even though such carts, technically speaking, were equipped in the same manner as the carts according to the invention.

It will be possible to vary the prize signals from the signal director at any time, both in the course of a single day and in the course of longer periods, e.g. a week.

Further, the system according to an embodiment of the invention makes it possible to include data relating to purchases having been made, both with regard to type and quantity of goods, in an evaluation of the type and extent of a reward, by having a stationary electronic recording apparatus adapted and connected in the manner set forth in claim 2.

Further advantageous embodiments, the effects of which are explained in the following detailed part of the present description, are set forth in claims 3 and 4.

BRIEF DESCRIPTION OF THE DRAWINGS

In the following detailed part of the present description, the invention will be explained in more detail with reference to the drawing, in which FIG. 1 diagrammatically shows an activity area with an embodiment of the system according to the invention, FIG. 2 diagrammatically shows a cart shed with a readiness bay and a gate for receiving service carts in the form of a stationary electronic apparatus situated at the same end of the readiness bay.

DESCRIPTION OF THE PREFERRED EMBODIMENT

Figure 1:
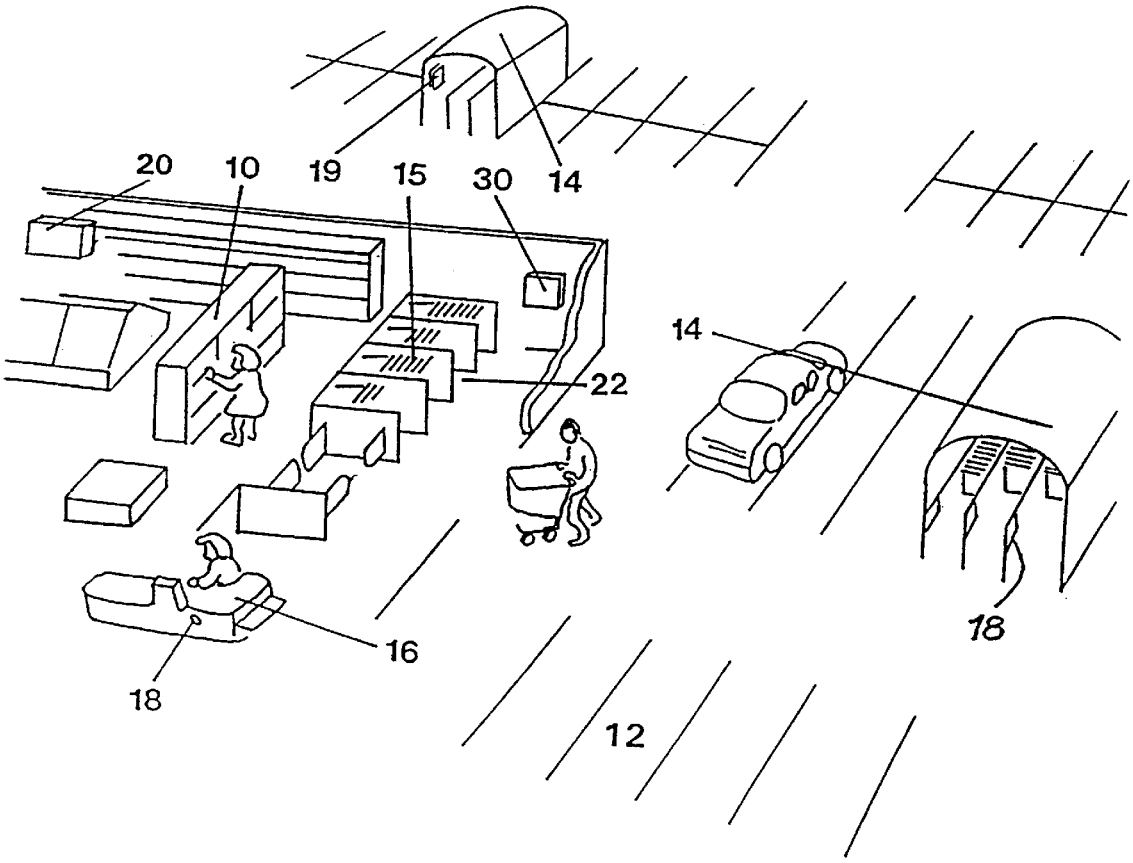

FIG. 1 shows an example of an activity area comprising business premises 10 for a supermarket, a parking lot 12 for the customers' cars, cart sheds 14 for service carts and a cash terminal 16 at the exit of the supermarket 10.

Further, the system comprises stationary, electronic devices 18. In the example shown, at least one of these is placed at one end of the cart shed 14, at least one at the tills of the cash terminal 16, and at least one in return stations 14 for service carts. The stationary devices 18 placed at the tills, as well as those placed at the cart sheds 14, are connected for communication with an electronic signal director 20. The signal director 20 is permanently and/or selectively controllable for recording and evaluation signals.

Figure 2:
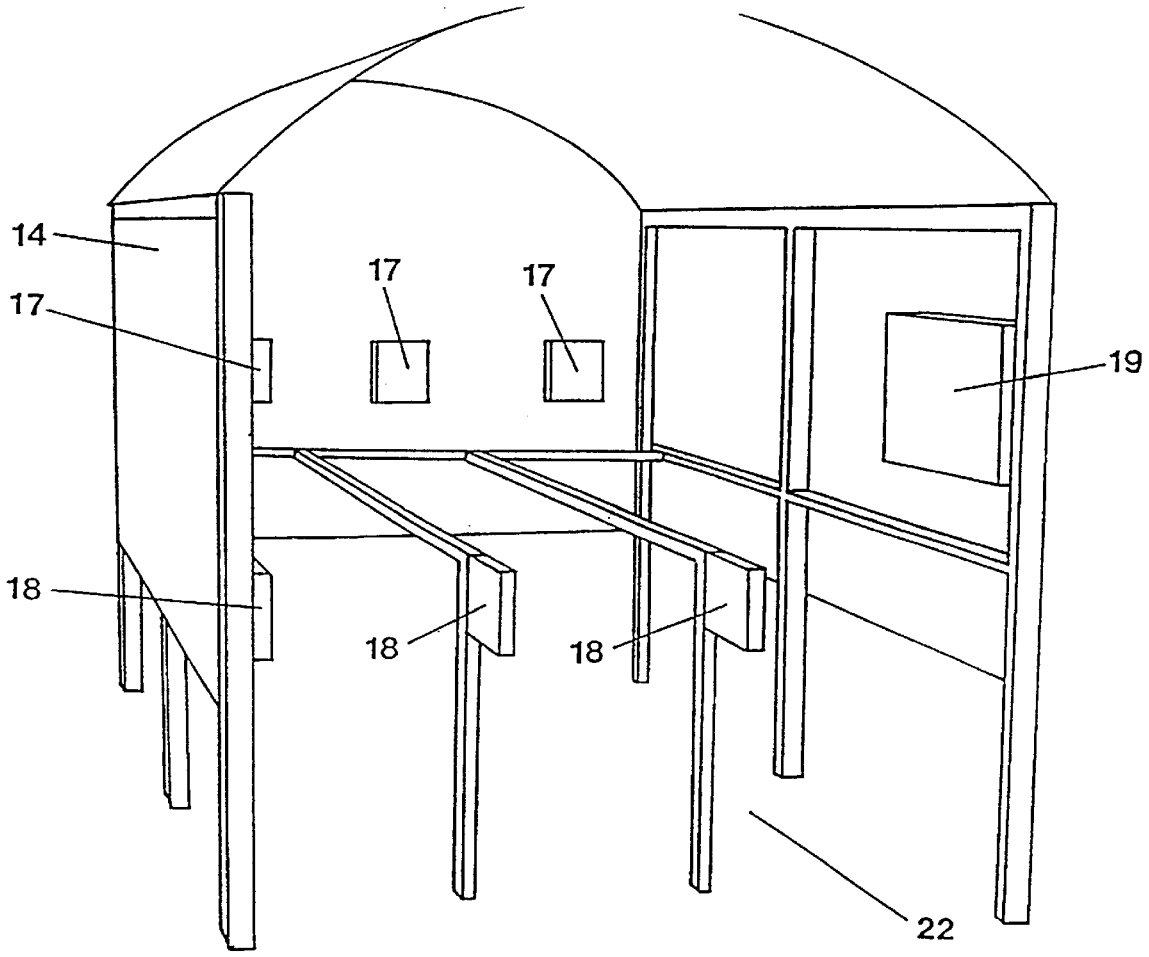

The cart sheds 14 are advantageously constructed in the manner shown in FIG. 2. Stationary electronic devices 18 are placed alongside gates formed by readiness bays 22 for service carts (not shown). A service cart will necessarily, both when being collected and when being returned, pass these devices.

Figure 3:
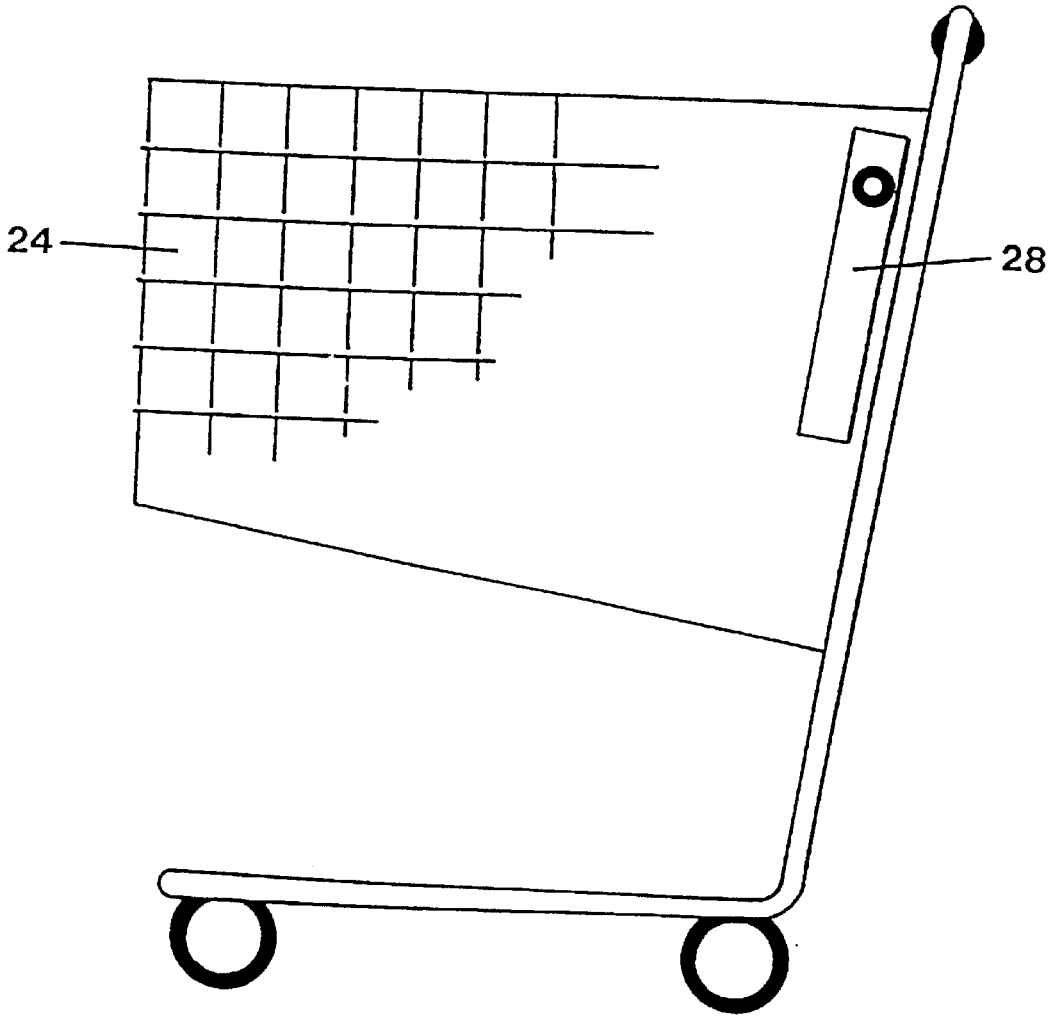
FIG. 3 shows a service cart constructed for use on the activity area.
Figure 4:
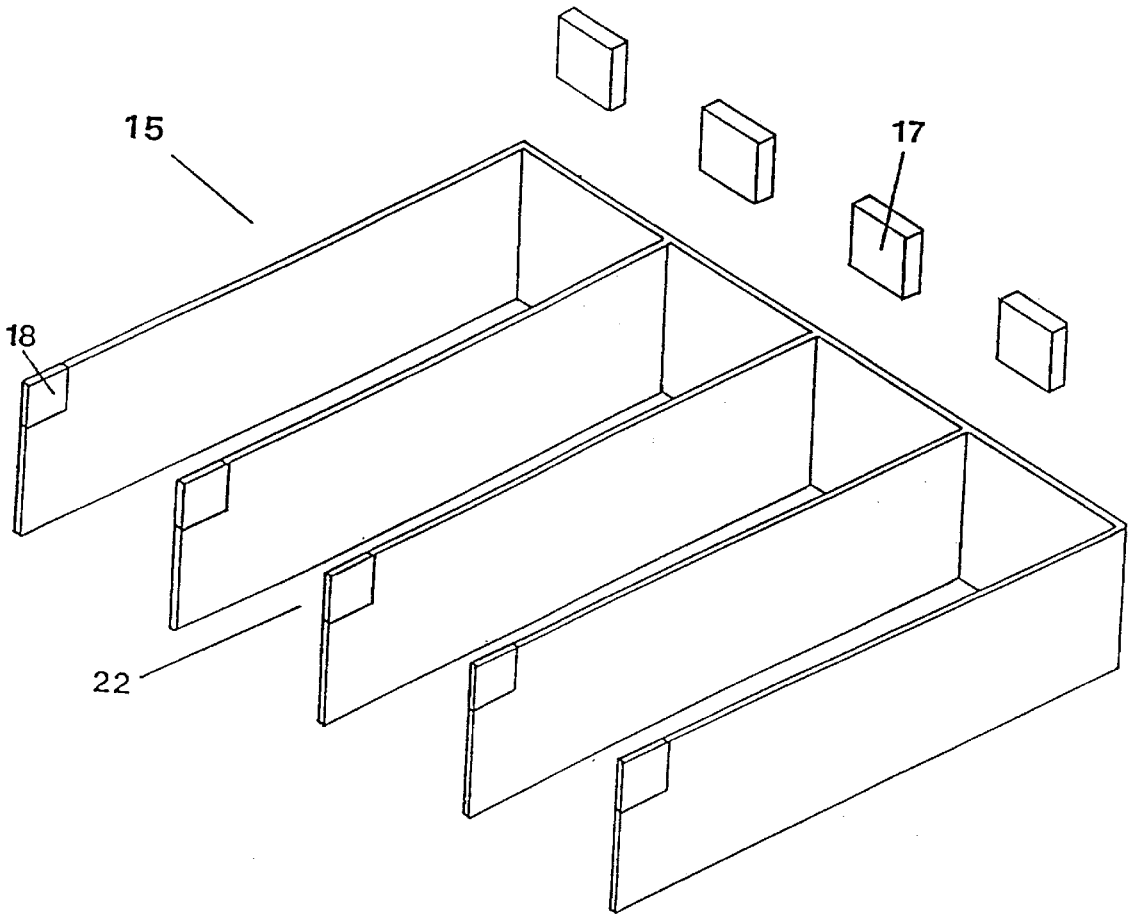
FIG. 4 shows an embodiment of readiness bays to be placed at an entrance to an activity area, FIG. 5 diagrammatically shows a voucher printed out from an indicator.
Figure 5:
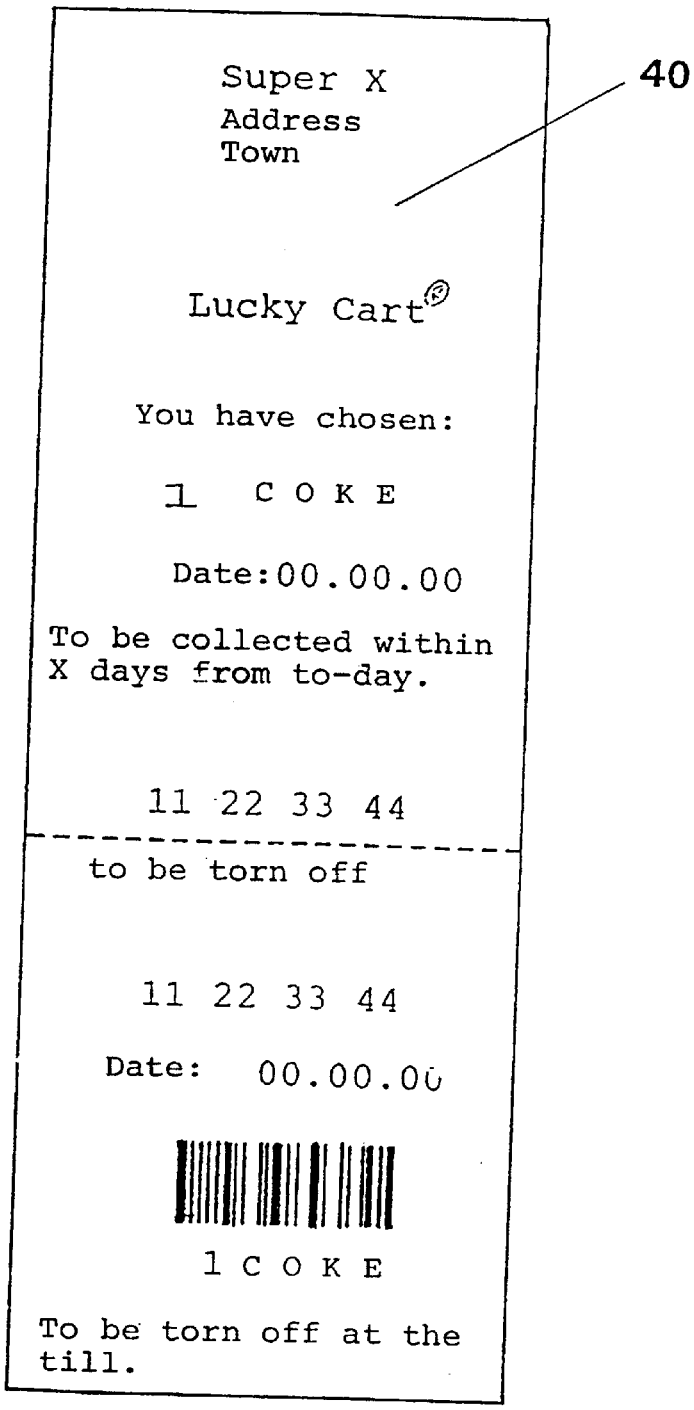

Service carts 24 adapted for use within the activity area, cf. FIG. 3, are likewise equipped with electronic communication devices 28; the latter are intended and constructed to be placed on the service carts 24 and comprise the mobile electronic devices 28 of the system.

The devices 18 are adapted for receiving, storing, evaluating as well as producing electronic signals. The devices 28 are adapted for receiving and producing electronic identification signals.

Figure 6:
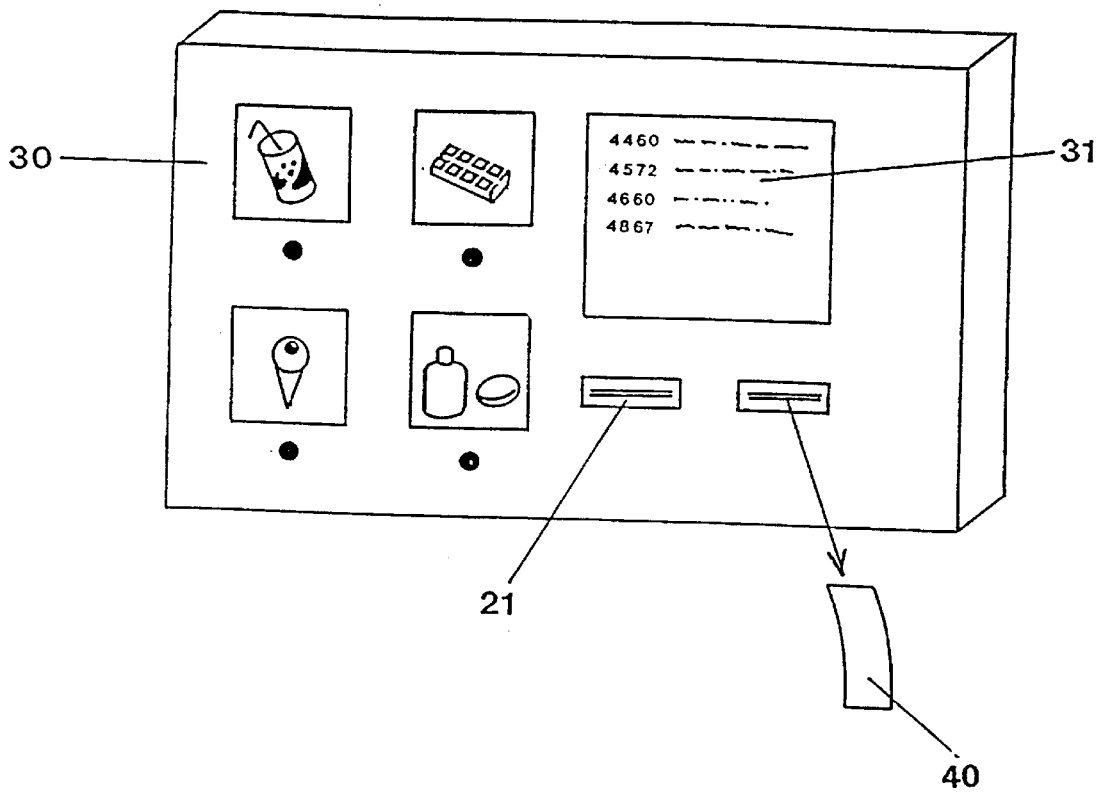
FIG. 6 shows an embodiment of an indicator.

The system also comprises a stationary electronic director-controlled indicator 30, c.f. FIG. 6, adapted to provide information about rewards occasioned by the user of the service cart 24 by advancing the latter through the system.

The system functions in the following manner:

When visiting the supermarket, a customer will take a service cart 24 from a delivery location, in the example shown a readiness bay, situated in a cart shed 14 or in the immediate vicinity of an entrance 15 to the activity area. It is also possible, however, to take a service cart 24 unexpectedly not having been returned to a readiness bay 22.

The customer will make her/his purchases in the traditional manner. When, after the completion of the purchases, the service cart 24 is taken through the cash terminal, the stationary electronic device 18 situated at a till 16 will send a recording signal to the signal director 20, this signal possibly being supplemented with an evaluation signal from the till with respect to the purchases having taken place.

The evaluation signal of the till 16 may be based, not only on a simple summation of the prices of the selected products, but may also—due to the connection between the till's stationary electronic device 18 and the electronic signal director 20—be determined by supplementary and variable factors, e.g. the size of the final amount, purchases of sponsored products and special offers; at the discretion of the supermarket, these factors can also by means of the single director 20 be varied so as to apply solely for selected periods of time, right down to selected times of the day.

The feeling of suspense whether the purchases having been made produce a reward will be released when the service cart 24, after having been emptied of purchased goods on the parking lot 12, is returned to the cart shed 14, in which the returning is recorded by an electronic device 18 at the entry to a readiness bay. Then, this recording can via an electronic indicator 17 initiate an optical and/or acoustical signal with the information that the returning of the service cart has occasioned a reward.

If a person returns the emptied and signal-initiating service cart to readiness bays 22 situated in the immediate vicinity of the entrance to the activity area, it is possible for the person to use the indicator 30 placed in the immediate vicinity to choose her/his reward(s), the latter being substantiated with a voucher by pressing a button on the indicator 30 adjacent the reward having been chosen. The indicator 30 can comprise a number of possibilities for allocating a reward, possibly allowing selection between different rewards, e.g. by pressing buttons.

The indicator can be incorporated in the electronic controls of the system, e.g. by means of vouchers being issued electronically upon return of the cart 24, and can be recorded in the administration section of the system upon the presentation of a reward having been collected as well as returning a part of the voucher in the till.

The indicator 30 can also be adapted to, at intervals of days or weeks, automatically to include one or a number of larger or smaller prizes in a lottery, in which the vouchers having been issued from the indicator 30 in a certain preceding period of time constitute lottery tickets. These larger or smaller prizes may be a certain sum of money to buy goods in the supermarket concerned within a certain time limit, a journey or a voyage, an amount in cash or something else.

Vouchers 40 being printed out from the indicator 30 can be provided with successive serial numbers.

The indicator 30 can be adapted to present the winning numbers of a certain period of time on a display 31, the prize or prizes having been announced being issued to the customer upon presenting her/his part of the voucher with the winning number to the staff.

In addition to indicating the name of the supermarket and the system's registered trademark, a voucher 40 having been printed out of the indicator 30 can indicate the prize having been chosen, possibly also a date within which the prize is to be collected.

The collection of the reward can take place by presenting the voucher at the till together with the reward having been collected, a bar code indicating that the reward has been collected and is not to be debited to the customer's account. For this reason, the bar code is adapted to the bar-code system being used in the supermarket concerned. The lower part of the voucher is torn off and kept in the till, whereas the upper part can be returned to the customer as a "lottery ticket" for a possible periodic lottery.

The voucher can also be provided with advertising space on the front side as well as on the back side.

Cart sheds 14, especially those situated at some distance, can be provided with a card dispenser and -reader 19 capable of being integrated with the card reader 21 in the indicator 30, so that it is possible for a person initiating a reward upon return of a service cart to accumulate points on a loyalty card or via a dispenser to be issued with a magnetic card, the latter when inserted into the card reader 21 occasioning a reward with associated voucher in the indicator 30.

LIST OF PARTS

10 business premises/supermarket
12 parking lot
14 cart shed/return station
15 entrance
16 cash terminal/till
17 electronic indicator
18 electronic device
19 card dispenser and reader
20 electronic signal director

21 card reader

22 readiness bay

24 service cart

28 electronic communication device

30 director-controlled indicator

31 display

40 voucher

What is claimed is:

1. Returning system for service carts (24), said system comprising elements for electronic monitoring of the movement of the carts (24) through an activity area, characterized in a) that the returning system is an electronic system operable in a deposit-free manner, the elements of said system being mutually related in a compulsorily activating manner from a collection station, at which the carts stand in readiness to be collected, and via an activity area again back to a readiness collection station, b) that the system comprises an electronic signal director (20) that is both controllable or controlling and comprises fixed and variable functions, c) that the system further comprises c1) mobile electronic communication devices (28) intended and constructed for placement on the system's service carts (24) so as to accompany the latter, each of said communication devices (28) being adapted for electronic identification of the particular service cart on which it is placed, and c2) stationary electronic devices (18) adapted to record the identity of the cart concerned and to be connected for communication to said signal director (20), said stationary devices (18) being placed in a mutual sequence in such a manner that they co-operate to form a path of advancement extending from a cart-collection station (14,15), through said activity area, and back to a cart-collection station (14,15), said path to be followed by the service carts (24) for triggering electrical signals for the activation of the signal director (20), and d) that said signal director (20) is connected for communication with an indicator (17,30) adapted to make known the giving of a reward caused by the returning of a cart.

2. System according to claim 1, characterized by a stationary electronic device (18) adapted to record the identity of a service cart and situated at or in a cash terminal (16), the latter likewise being adapted to be connected for communication with said signal director (20) and to supplement recording signals with evaluation signals transmitted from said cash terminal (16) and relating to the quantity or the value or the type of goods carried by the service cart (24).

3. System according to claim 1, characterized by a stationary electronic device (18) adapted to record the identity of the service cart and being placed at a readiness bay (22) situated at a collection station, said bay (22) being constructed in such a manner that a service cart (24) must necessarily pass said device both when being collected and when being returned.

4. System according to claim 1, characterized in that said indicator (30) is adapted to provide information for a user having been awarded a reward for returning her/his service cart, optically, acoustically or by issuing a voucher (40).

* * * * *